US009500422B2

(12) United States Patent
Gomirato et al.

(10) Patent No.: US 9,500,422 B2
(45) Date of Patent: Nov. 22, 2016

(54) GAS OPERATING SYSTEM FOR SMALL ARMS WITH SPRING LOADED GAS VALVE

(71) Applicant: BERETTA USA CORP., Accokeek, MD (US)

(72) Inventors: Andrea Gomirato, Hendersonville, TN (US); Francesco Franzini, Accokeek, MD (US)

(73) Assignee: BERETTA USA CORP., Accokeek, MD (US)

( * ) Notice: Subject to any disclaimer, the term of this patent is extended or adjusted under 35 U.S.C. 154(b) by 0 days.

(21) Appl. No.: 14/790,517

(22) Filed: Jul. 2, 2015

(65) Prior Publication Data

US 2016/0003566 A1 Jan. 7, 2016

Related U.S. Application Data

(60) Provisional application No. 62/019,974, filed on Jul. 2, 2014.

(51) Int. Cl.

| | |
|---|---|
| ***F41A 5/20*** | (2006.01) |
| ***F41A 5/28*** | (2006.01) |
| *F41A 21/30* | (2006.01) |
| *F41A 21/34* | (2006.01) |

(52) U.S. Cl.

CPC .. *F41A 5/20* (2013.01); *F41A 5/28* (2013.01); *F41A 21/30* (2013.01); *F41A 21/34* (2013.01)

(58) Field of Classification Search

CPC ..... F41A 5/18; F41A 5/20; F41A 5/24; F41A 5/26; F41A 5/28; F41A 21/30; F41A 21/34

USPC ..... 89/43.01, 43.02, 191.02

See application file for complete search history.

(56) References Cited

U.S. PATENT DOCUMENTS

| | | | | |
|---|---|---|---|---|
| 2,252,754 A | | 8/1941 | Browning | |
| 3,988,964 A | | 11/1976 | Moore | |
| 4,279,191 A | * | 7/1981 | Johansson | F41A 21/484 89/185 |
| 4,373,423 A | * | 2/1983 | Moore | F41A 5/26 89/191.02 |
| 4,817,496 A | | 4/1989 | Zedrosser | |

(Continued)

FOREIGN PATENT DOCUMENTS

FR 880417 * 3/1943

OTHER PUBLICATIONS

International Search Report and Written Opinion of the International Searching Authority dated Sep. 16, 2015 for Application No. PCT/US2015/038968.

*Primary Examiner* — Stephen M Johnson
(74) *Attorney, Agent, or Firm* — Ladas & Pary LLP

(57) ABSTRACT

A gas operating system for engaging the automatic or semi-automatic action of small arms. The system has a short, displaceable cylinder with a gas block ring secured thereto, a short, fixed piston attached coaxially to a gun barrel, and a single locking nut, advantageously in the form of a threaded flash suppressor. The piston includes gas block rings at its rearward exterior surfaces. The cylinder has a short stroke between radial forward and rear stops fixed on the barrel, which short stroke may be finely adjusted by threaded axial displacement of the rear stop. Pressurized combustion gas from fired ammunition fills a gas chamber formed by the interiors of the piston and cylinder, the gas entering through radial ports in the barrel. The system may be machined and assembled/disassembled with ease and may be readily adapted for employment in any small arms. The system may be fine tuned for usage with a wide spectrum of ammunition.

15 Claims, 12 Drawing Sheets

(56) References Cited

U.S. PATENT DOCUMENTS

| | | | |
|---|---|---|---|
| 8,640,598 | B1 | 2/2014 | Jackson |
| 8,887,616 | B2 | 11/2014 | Kenney |
| 2012/0137871 | A1 | 6/2012 | O'Brien |
| 2013/0291713 | A1 | 11/2013 | Zheng |

* cited by examiner

GAS OPERATING SYSTEM FOR SMALL ARMS WITH SPRING LOADED GAS VALVE

RELATED APPLICATION

The present application claims the benefit under 35 U.S.C. 119(e) of U.S. Provisional Appln. No. 62/019,974 filed Jul. 2, 2014, the entire contents of which are incorporated herein by reference.

BACKGROUND OF THE INVENTION

Automatic and semi-automatic weapons have employed a variety of gas-operated systems utilizing the pressure of combustion gases released upon firing of a round to engage and displace a piston operatively associated with a bolt mechanism to unlock, extract, eject, feed, reload, lock and cock before firing the next round. Most of the prior art systems employ a piston-cylinder arrangement mounted parallel with the gun barrel, although U.S. Pat. No. 4,817,496 proposes utilizing the gun barrel itself as an in situ piston with large and small outer diameters being operatively associated with a sliding cylinder having corresponding large and small linear diameter portions mounted coaxially with and displaceable relative to the gun barrel. Such a system is subject to undue thermal expansion of the multi-diameter gun barrel negatively affecting operability and reliability. Moreover, such a system having a long stroke requires elaborate machining of the gun barrel outer surfaces and the cylinder for effecting the comparatively long stroke of the cylinder.

There exists, therefore, a need to provide a novel system that overcomes the above-noted and other drawbacks of the existing systems.

SUMMARY OF THE PRESENT INVENTION

The present invention is directed to a new and improved gas operating system for engaging the automatic or semi-automatic action of small arms. The new operating system in one aspect has essentially three fundamental components: a short, displaceable cylinder with a gas block ring secured thereto, a short, fixed piston attached coaxially to a gun barrel, and a single locking nut, advantageously in the form of a threaded flash suppressor. The piston includes gas block rings at its rearward exterior surfaces. The cylinder has a short stroke between radial forward and rear stops fixed on the barrel, which short stroke may be finely adjusted by threaded axial displacement of the rear stop.

Pressurized combustion gas from fired ammunition fills a gas chamber formed by the interiors of the piston and cylinder, the gas entering through radial ports in the barrel. The new gas operating system may be machined and assembled/disassembled with great ease and may be readily adapted for employment in any small arms. The system may be fine tuned for usage with a wide spectrum of ammunition.

In refined embodiments, either a manually adjustable valving mechanism or an automatic valving mechanism is associated with the piston to permit controlled escape of combustion gases through the forward piston wall to reduce the pressure in the gas chamber.

The present invention in one aspect provides a gas operating system for engaging the automatic or semi-automatic action of a small arms weapon. The system comprises a gun barrel having a plurality of radial ports and having radial forward and rear stops fixed thereon. The system further comprises a displaceable cylinder with a gas ring block secured thereto, the cylinder having a short stroke between the radial forward and rear stops fixed on the gun barrel. The system further comprises a fixed piston attached coaxial to the gun barrel and having gas block sealing rings at rearward exterior surfaces of the piston. A gas chamber is formed by interior walls of the cylinder and piston and by outer surfaces of the gun barrel, wherein gas tightness of the gas chamber is established by the gas ring block of the cylinder and by the gas blocking sealing rings of the piston. The gas chamber receives in operation pressurized combustion gas from fired ammunition, the gas entering through the radial ports of the gun barrel. The system further comprises a single locking nut comprising a threaded flash suppressor, configured to lock the piston over the gun barrel. The rear stop is cylindrical and is threaded axially to the gun barrel so that the rear stop is rotatable to finely adjust the short stroke of the cylinder.

The present invention in another aspect provides a gas operating system for engaging the automatic or semi-automatic action of a small arms weapon. The system comprises a gun barrel having a plurality of radial ports. A fixed piston is mounted coaxial with and secured to the gun barrel, the piston having annular grooves formed on rearward outer walls of the piston and gas blocking sealing rings disposed in the annular grooves. A sliding cylinder is mounted telescopically on the piston, the cylinder having inner surfaces and an interior wall and being open at a forward end and closed by a rear wall. A gas chamber is formed in part by the interior wall of the cylinder and outer surfaces of the gun barrel and further by the inner surfaces and a rear wall of the cylinder. The rear wall of the cylinder has a circular opening supporting a gas sealing ring of the cylinder which slidingly and sealingly engages the outer surfaces of the gun barrel, wherein gas tightness of the gas chamber is established by the gas sealing ring of the cylinder and by the gas blocking sealing rings of the piston. The gas chamber is being configured to, in operation, receive from the gun barrel pressurized combustion gas from fired ammunition, the gas entering through the radial ports of the gun barrel, the gas acting against the cylinder to effect rearward movement of the cylinder with respect to the piston. A bolt carrier 40 freely engages the rear wall of the cylinder and is configured to be engaged by the rearward movement of the cylinder to start the action of the weapon. The bolt carrier is forward biased and in operation urges the cylinder back to its forwardmost position, thereby expelling gas from the gas chamber back through the radial ports and out the gun barrel.

The present invention in another aspect provides a gas operating system for engaging the automatic or semi-automatic action of a small arms weapon. The system comprises a gun barrel having a plurality of radial ports and having radial forward and rear stops fixed thereon. The system further comprises a displaceable cylinder with a gas ring block secured thereto, the cylinder having a short stroke between the radial forward and rear stops fixed on the gun barrel. A fixed piston is attached coaxial to the gun barrel and has gas block sealing rings at rearward exterior surfaces of the piston. A gas chamber is formed by interior walls of the cylinder and piston and by outer surfaces of the gun barrel. Gas tightness of the gas chamber is established by the gas ring block of the cylinder and by the gas blocking sealing rings of the piston. The gas chamber receives in operation pressurized combustion gas from fired ammunition, the gas entering through the radial ports of the gun barrel. The rear stop is cylindrical and is threaded axially to the gun barrel so that the rear stop is rotatable to finely adjust the short stroke of the displaceable cylinder.

For a more complete understanding of the operation of gas operating system of the invention and a better appreciation of its attendant advantages, reference should be made to the following detailed description taken in conjunction with the accompanying drawings.

DETAILED DESCRIPTION OF THE PREFERRED EMBODIMENTS

Figure 1:
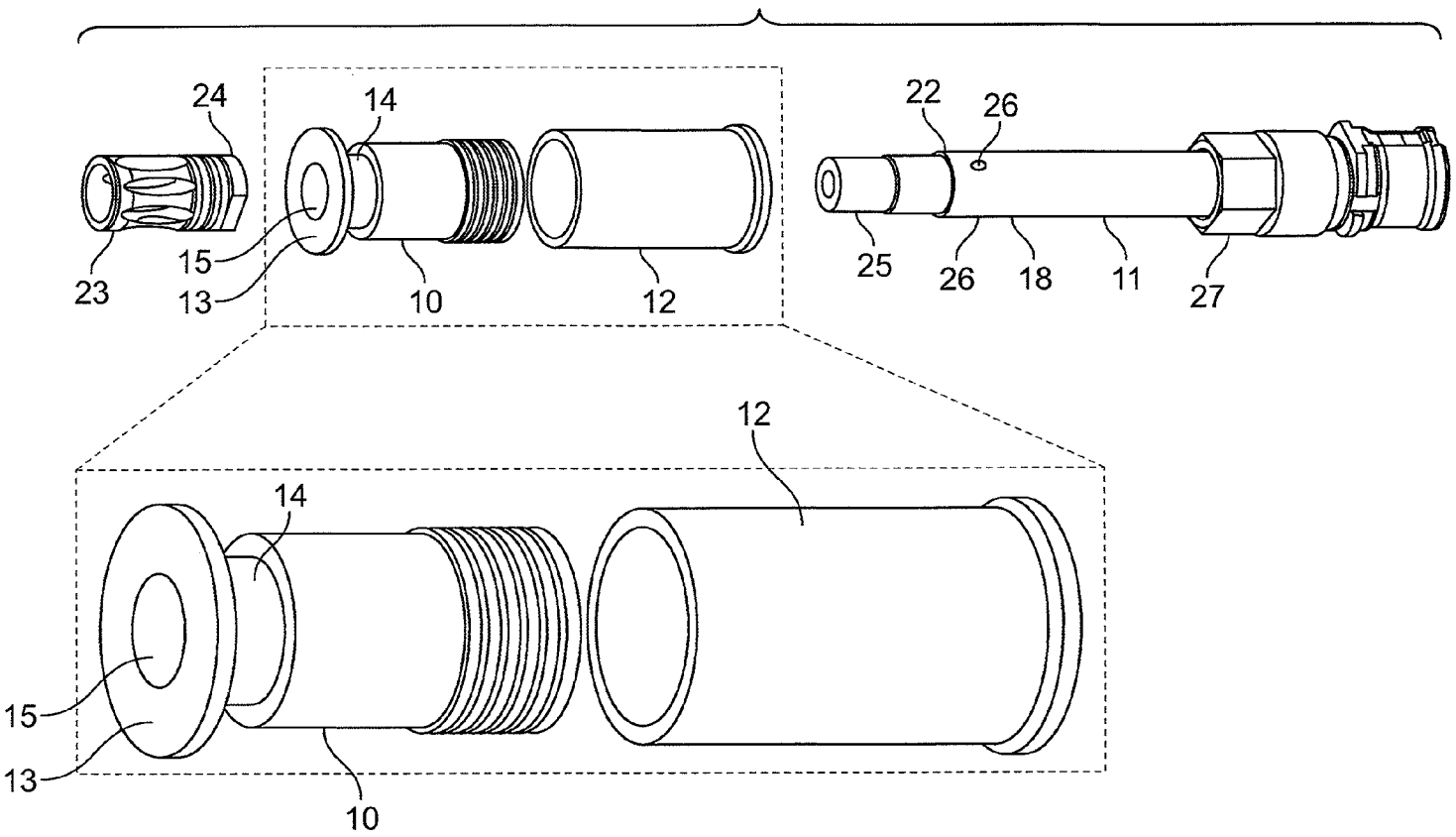
FIG. 1 is an exploded perspective view of the fundamental elements of the gas operating system of the invention according to one embodiment.
Figure 2:
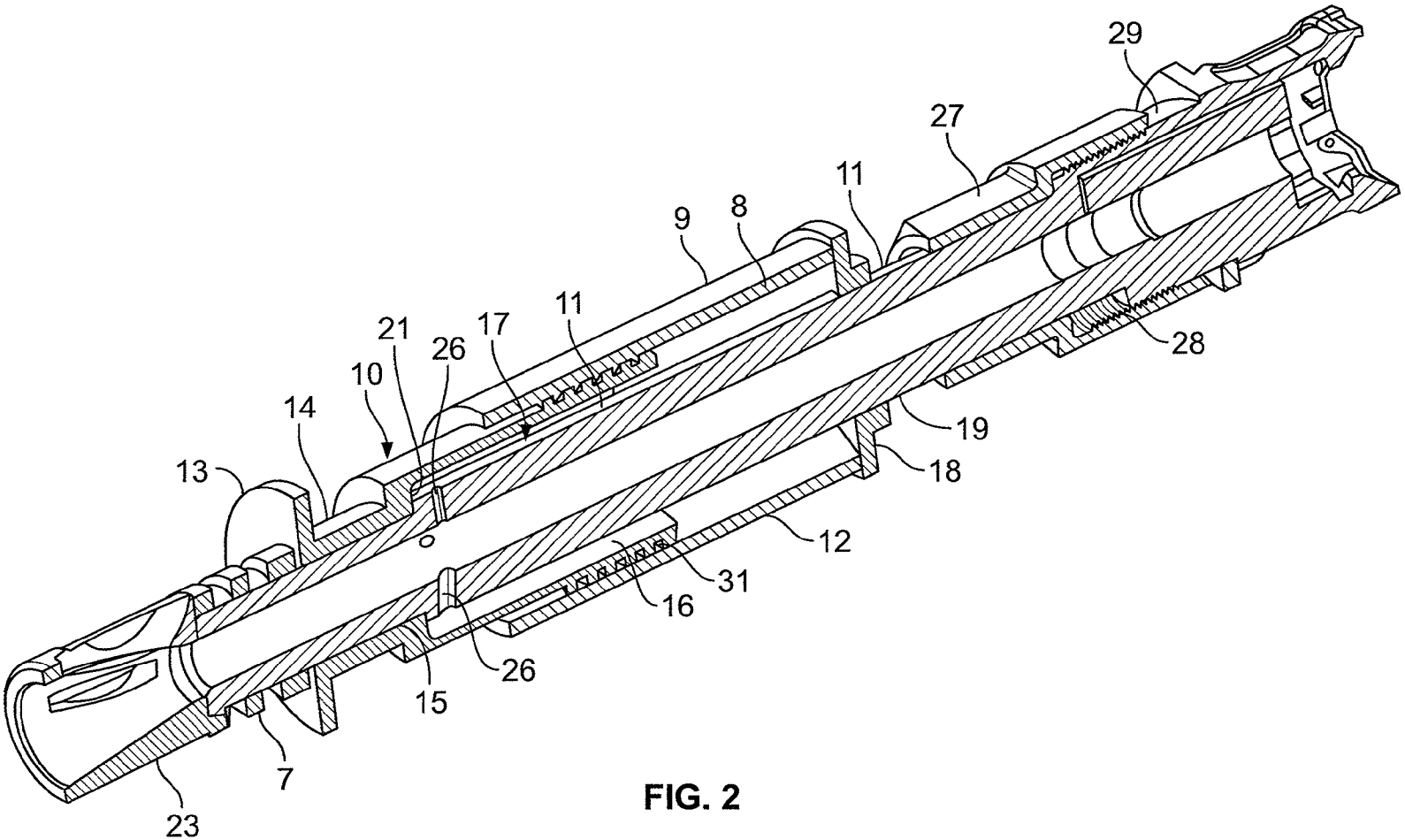
FIG. 2 is a perspective view of the piston and a cylinder, in mid-stroke position, and a locking element assembled with a gun barrel.

Referring now to FIGS. 1 and 2, the new gas operating system includes a piston element 10 mounted coaxially with and secured to a gun barrel 11 with a sliding cylinder 12 mounted telescopically on the piston for limited axial movement with respect thereto. The piston element 10 has a forwardly projecting collar 14 with an annular stop disc 13 at its outer forward end. Sealing rings 30 (FIG. 4) are mounted in annular grooves 31 of the piston 10. A gas chamber 17 (FIG. 2) is defined in part by inner cylindrical piston wall 9 and outer barrel surfaces 11. As can be seen in FIG. 2, the cylinder 12 slides over the piston 10 and over the barrel 11. A flash hider 7 is used also to tighten the piston 10 against the barrel 11

Figure 3:
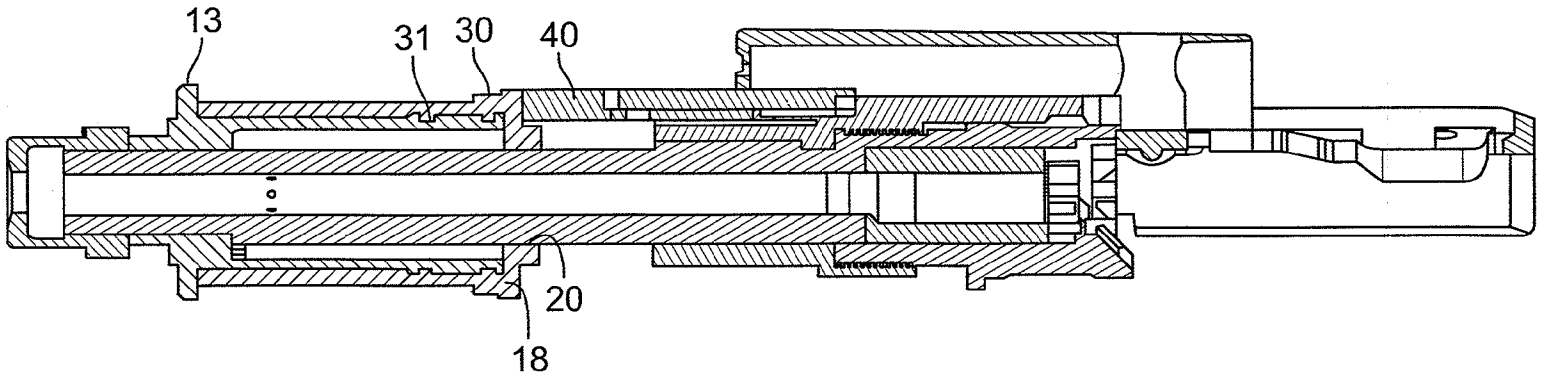
FIG. 3 is a cross-sectional view of the gas operating system with the cylinder in its forwardmost position.

The cylinder 12 is open at its forward end and is closed by a rear wall 18 which has a circular opening 19 supporting a gas sealing ring 20 (FIGS. 3 and 4) which slidingly, sealingly engages the outer surfaces 11 of the gun barrel. The inner surfaces 8 and rear wall 18 of the cylinder 11 complete the gas chamber 17 as will be understood. The sealing rings 30 and 20 maintain gas tightness of the chamber 17 and provide bearing surfaces for the cylinder to reciprocate over the piston 10 and gun barrel 11.

Specifically, the piston element 10 includes a shoulder 21 which engages a shoulder 22 formed on the outer barrel surface. In accordance with the invention, the piston element may be slipped over the barrel 11 until the shoulders 21 and 22 are engaged and then may be locked in place by threading a locking nut member 23, advantageously in the form of a flash suppressor having internal threads 24, over the threaded end 25 of the gun barrel 11. This permits simple and rapid assembly and disassembly in accordance with the principles of the invention. Alternatively, the piston element 10 itself may be directly threadedly fastened to the barrel 11 eliminating the lock nut member.

The gun barrel has a series of radial ports 26 communicating with chamber 17 which permit combustion gases under pressure to leave the bore of the barrel 11 and fill the gas chamber 17 to act against the cylinder to displace it rearwardly with respect to the piston 10. The number and dimensions of the ports 26 may be varied for different power ammunition. The rearward movement of the cylinder will engage the bolt carrier 40 to start the "action" of the weapon.

The forward travel of the cylinder 12 is limited by the stop disc 15; the rearward travel of the cylinder 12 is limited by a cylindrical rear stop 27 secured by interior threads 28 to mating threads 29 on the barrel. Thus, the total length of the cylinder displacement or cylinder stroke may be precisely adjusted to lengthen or shorten it by rotatingly threading the rear stop 27 along the barrel.

Figure 4:
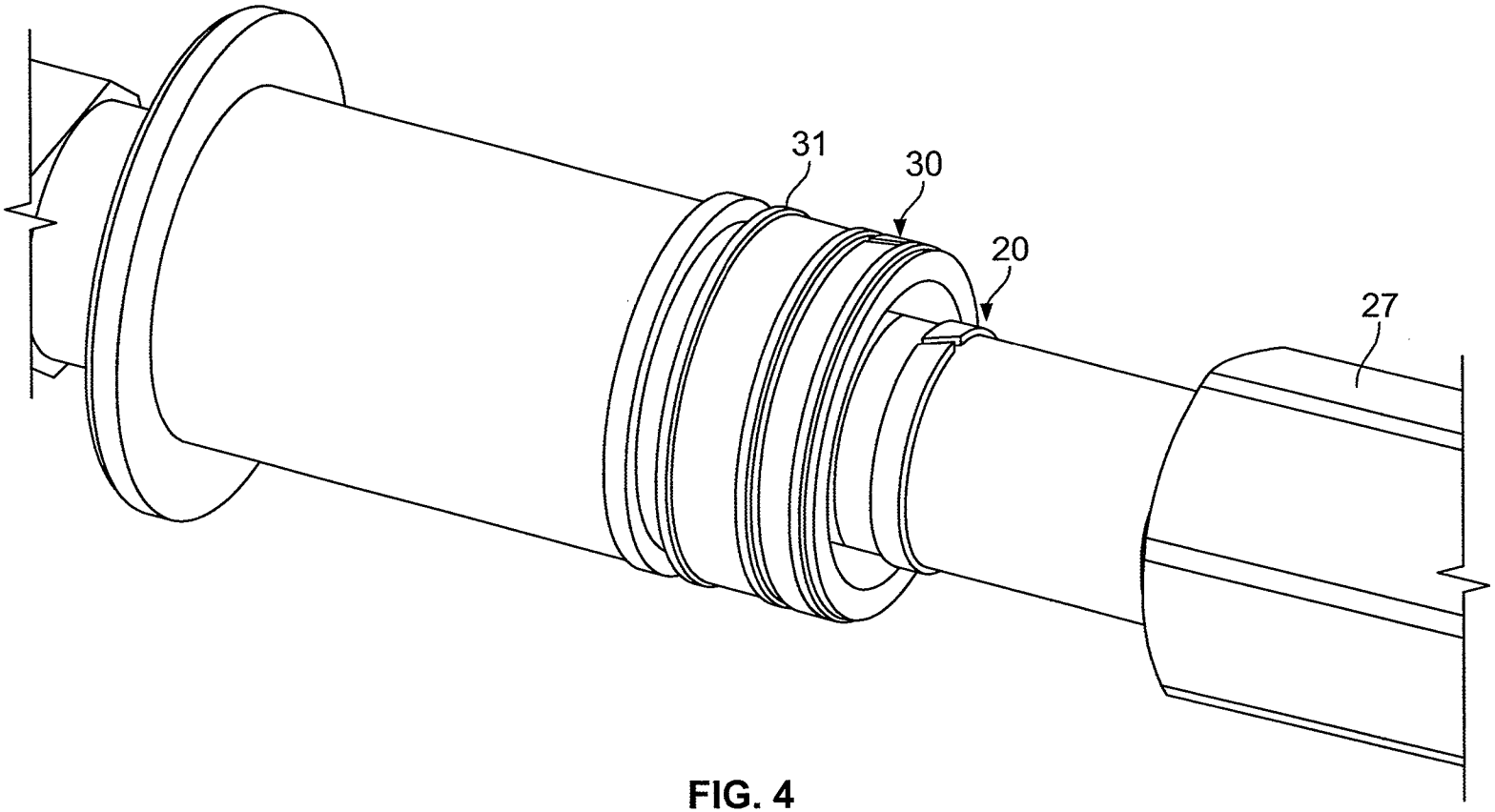
FIG. 4 is an enlarged perspective view of the piston schematically showing the locations of gas sealing rings which are incorporated into the outer surfaces of the piston and in the rear wall of the sliding cylinder.

In accordance with the invention, gas blocking sealing rings 30 are disposed in annular retaining channels 31 formed on the outer walls of the piston 12 (FIG. 4). The rings 30 establish the gas tightness of the dynamic gas chamber 17 formed by the cooperation of the sliding cylinder 12 and the fixed piston 10. Advantageously the sealing rings 30 may be of different, harder grade steel than that of the piston and cylinder, e.g., 17/7 stainless steel for the rings and 416 stainless steel for the piston and cylinder.

In operation, a small arms weapon incorporating the new gas operating system will include a bolt carrier mechanism 40 having an arm element freely engaging the rear wall 18 of the cylinder without mechanical fastening thereto. Typically, the bolt carrier 40 will be forwardly biased by springs (not shown) to urge the cylinder 12 into its forwardmost position shown in FIG. 3 after a trigger squeeze fires a round. At this stage, the projectile separated from the cartridge by combustion gas will leave the barrel and the pressurized combustion gases will enter the chamber 17 acting against the cylinder 12 to force it rearwardly moving the bolt carrier against its spring loading to effect the functions of unlocking and ejecting the spent cartridge and then chambering a fresh round while cocking the firing mechanism (the "action" which may be automatic or semi-automatic.) The next trigger squeeze or continuing the squeeze starts the firing cycle over as will be understood.

In each cycle, excess combustion gas is expelled from the gas chamber 17 and back through ports 26 and out the barrel 11 when the cylinder 12 reciprocates forwardly under spring bias from the bolt carrier. This provides self-cleaning and eliminates carbon powder build-up.

Figure 5:
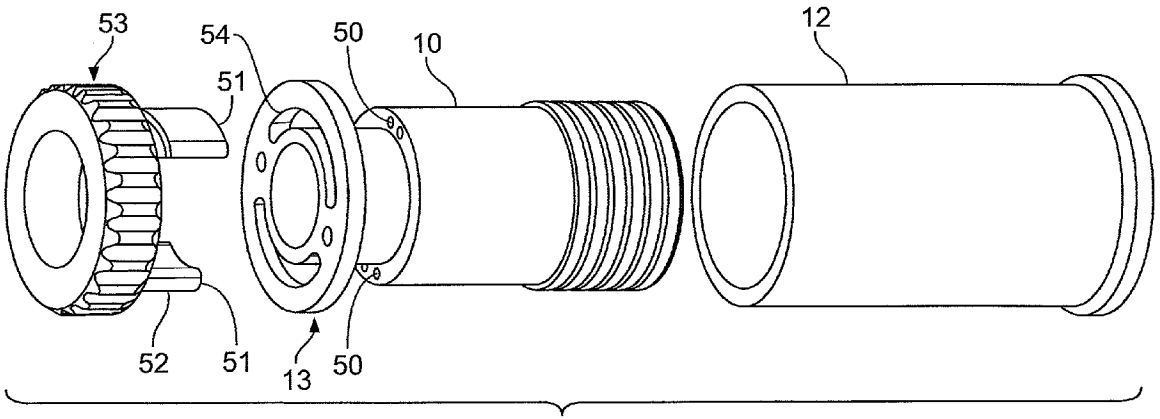
FIGS. 5 and 5A are exploded perspective views of an alternate preferred embodiment of the invention including a valving system.
Figure 5A:
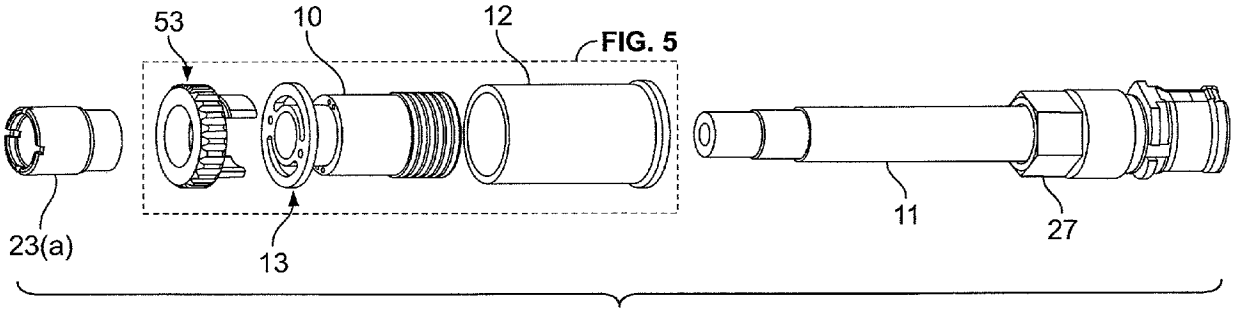

In instances where the nature of the ammunition employed creates undue pressure in the gas chamber 17, a simple manual valving arrangement for the piston 10 may be incorporated. Relief of pressure is provided by ventilation ports 50 formed in the piston forward wall and selectively closeable by stopper surfaces 51 on arms 52 of an associated rotatable collar 53 supported in slots 54 (e.g., semi-circular or some other suitable configuration) formed in the front stop disc 13. This valving arrangement is shown in FIGS. 5 and 5A where the threaded locking nut member 23(*a*) fixes the piston 10 to the forward end of the barrel 11 in the manner described hereinabove and shown in FIGS. 2 and 3.

Figure 6:
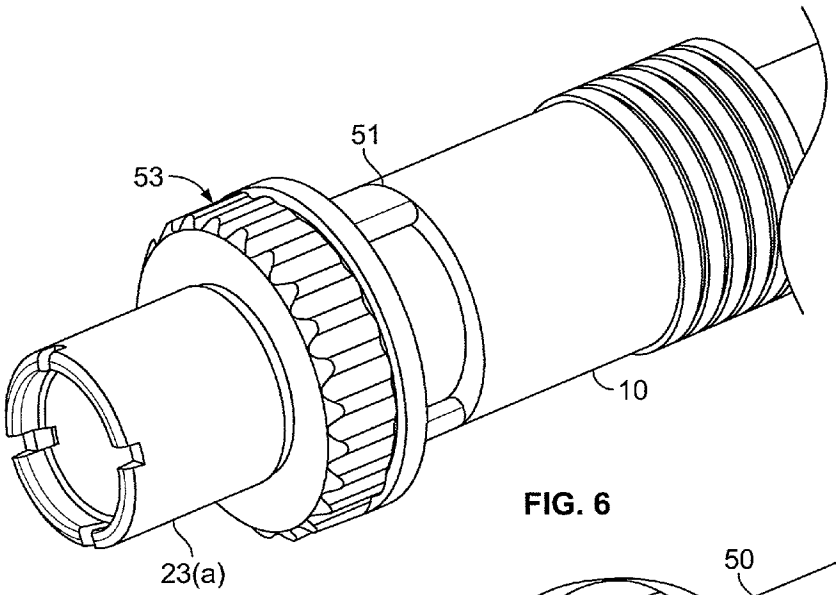
FIG. 6 is a perspective view showing the valving system of FIG. 5 "closed;"
Figure 7:
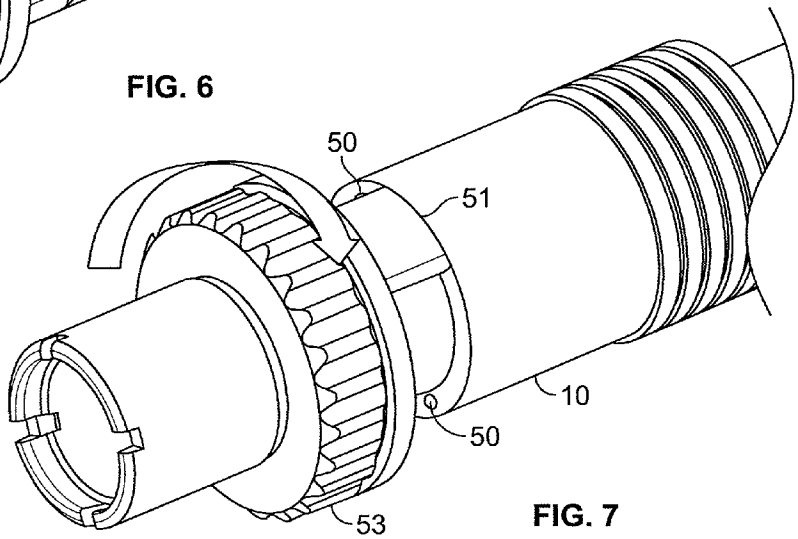
FIG. 7 is a perspective view showing the valving system of FIG. 5 "open;"

As shown in FIGS. 6 and 7, the ventilation ports 50 may be selectively opened and closed to adjust and to control chamber pressure by manually rotating the collar 53 to move the arms into and out of ventilation port opening and closing positions. As shown in FIG. 6, with the valve in the "close" position, no gas will come out from the piston 10 during the firing. As shown in FIG. 7, with the valve in the "open" position, part of the gas will go out from the piston 10, reducing the internal pressure. The dimensions and number of ports 50 may be varied to correlate with pressures generated by different ammunition strength. Any known detenting mechanism may be included in this simple valving arrangement, if desired to provide a series of discrete positions.

Alternatively to the manual rotatable valving arrangement of FIGS. 5A, 5B, 6, and 7, a spring-biased two phase (open/closed) valving system shown in FIGS. 8-14 may be advantageously employed. The spring-loaded valving system of this embodiment is designed to avoid the adjustments from the operator.

Figure 8:
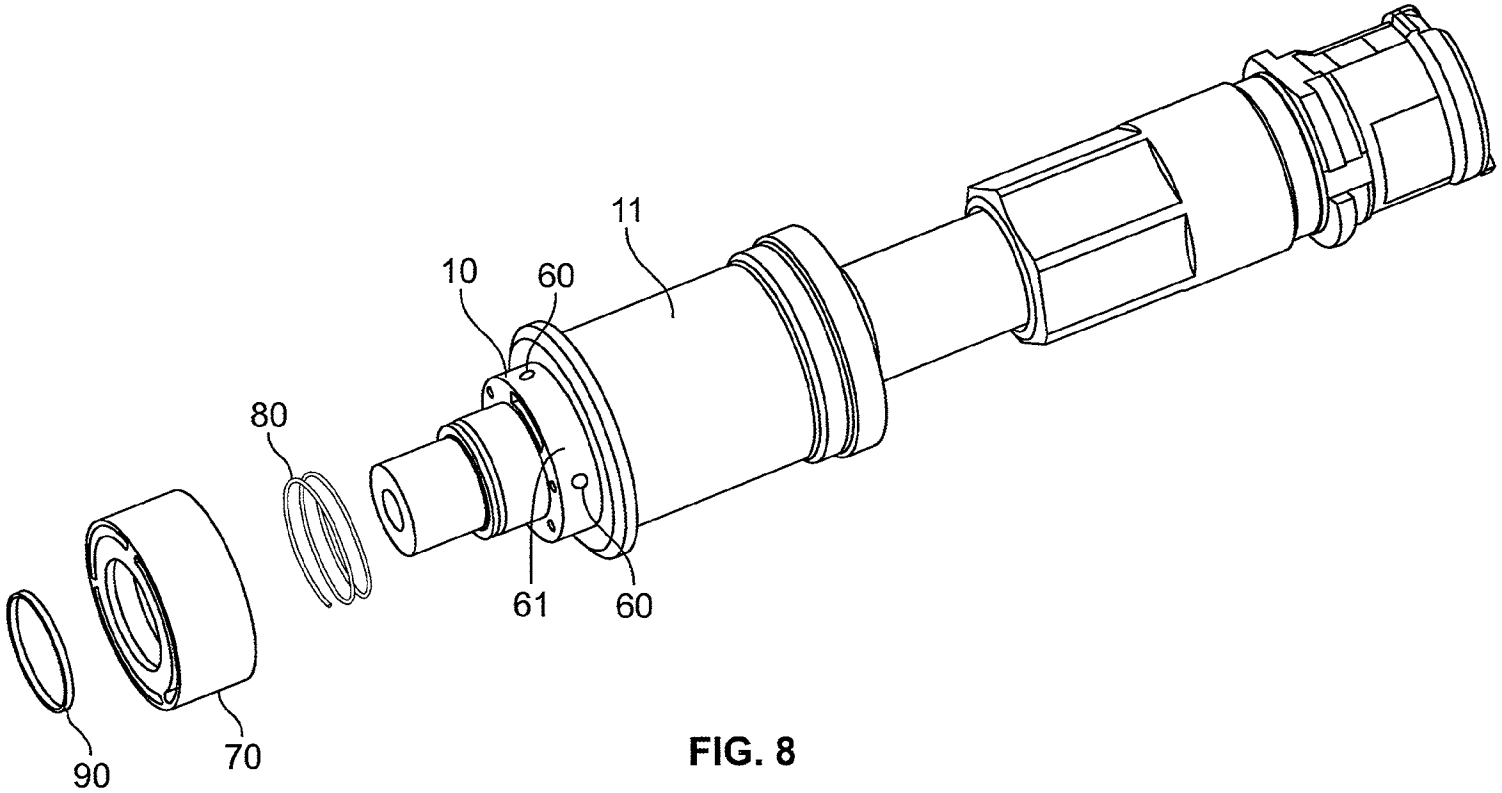
FIG. 8 is an exploded perspective view of another alternate preferred valving arrangement.
Figure 10:
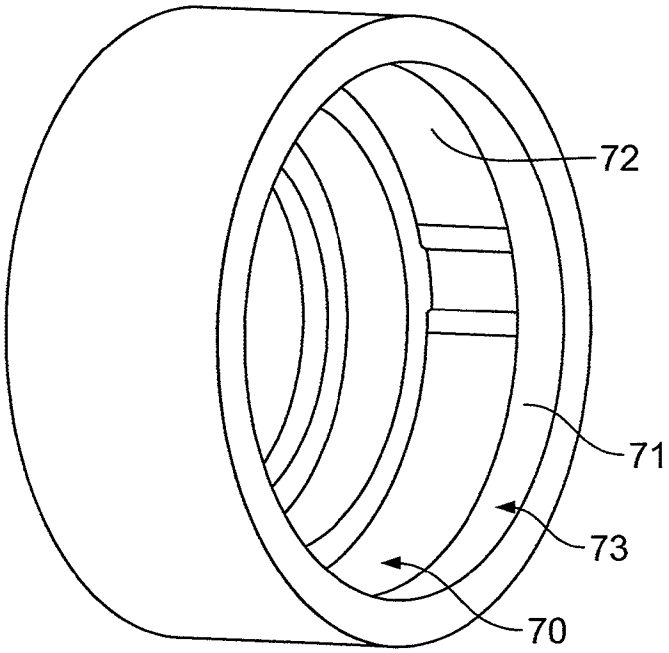
FIG. 10 is a rear perspective view of the valve member shown in FIG. 8.
Figure 9:
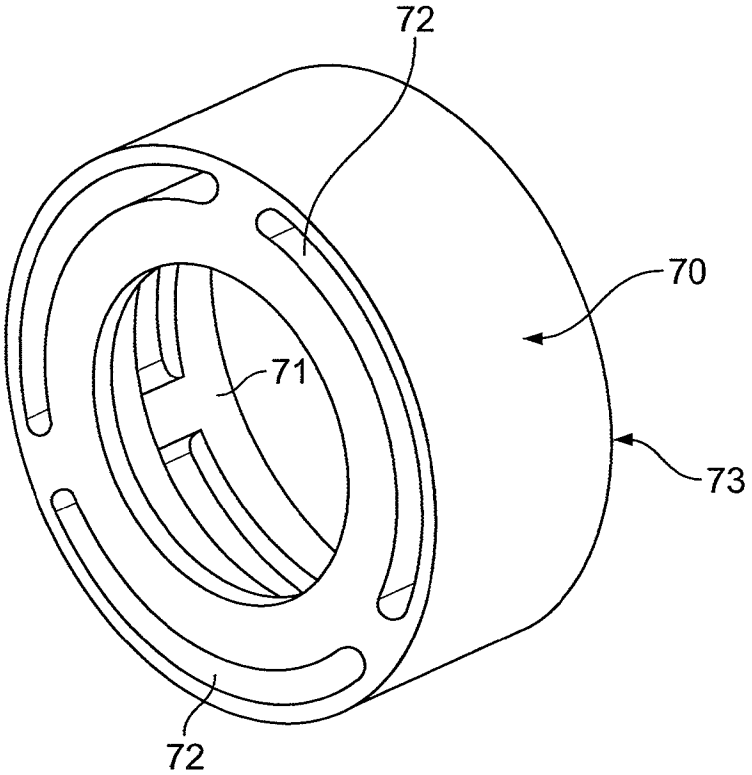
FIG. 9 is a front perspective view of the valve member shown in FIG. 8.
Figure 11:
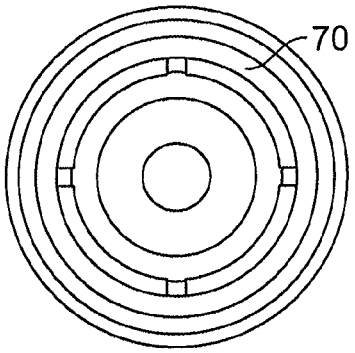
FIG. 11 is a front cut-out view of the spring biased valve in closed position.
Figure 11A:
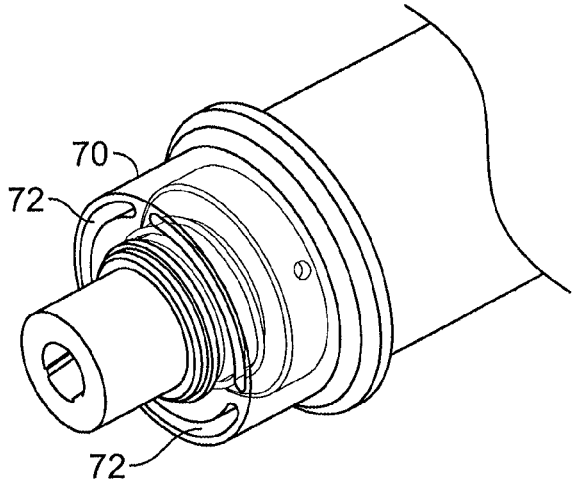
FIG. 11A is a perspective view of the spring biased valve in closed position.
Figure 11B:
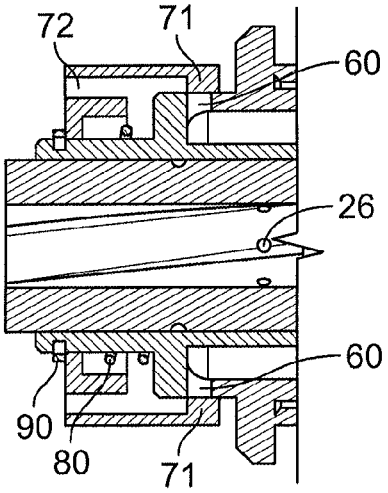
FIG. 11B is a cross-sectional view of the spring biased valve in closed position.

As shown in FIG. 8, the piston 10 has radial ports 60 formed in a forwardly extending annular collar 61. An associated cylindrical valve 70 is mounted for limited axial movement on the gun barrel with respect to the piston ports 60. Specifically, the valve 70 has a rear cylindrical collar 71 which is normally biased forwardly by a biasing spring 80 into the valve "closed" position shown in FIGS. 11A and 11B with the collar surfaces or sealing surfaces 73 blocking the radial ports 60 in the piston. Venting channels 72 are formed forwardly of the collar 71. The valve 70 itself is secured to the barrel by a snap ring 90, to prevent the valve 70 from coming off the system. Thus, as shown in FIGS. 11A and 11B, with the valve 70 in the "CLOSE" position, no gas will come out from the piston 10 during the firing; the sealing surface 73 will close the exit holes or radial ports 60 of the gas piston 10.

Figure 12:
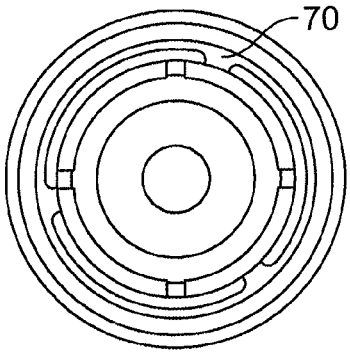
FIG. 12 is a front cut-out view of the spring biased valve in open position.
Figure 12A:
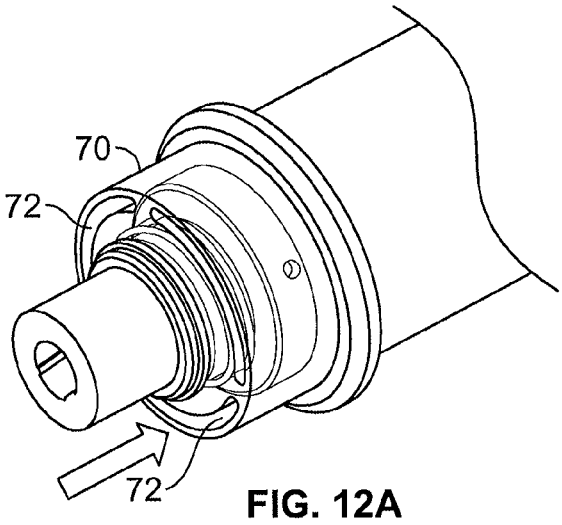
FIG. 12A is a perspective view of the spring biased valve in open position.
Figure 12B:
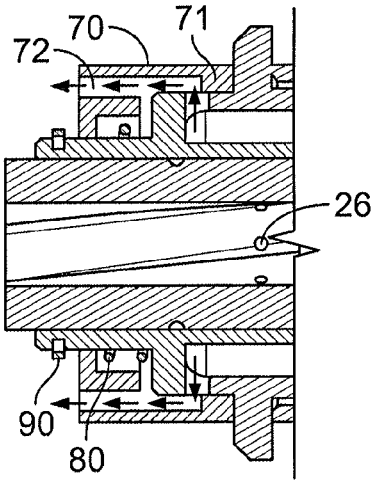
FIG. 12B is a cross-sectional view of the spring biased valve in open position.
Figure 13:
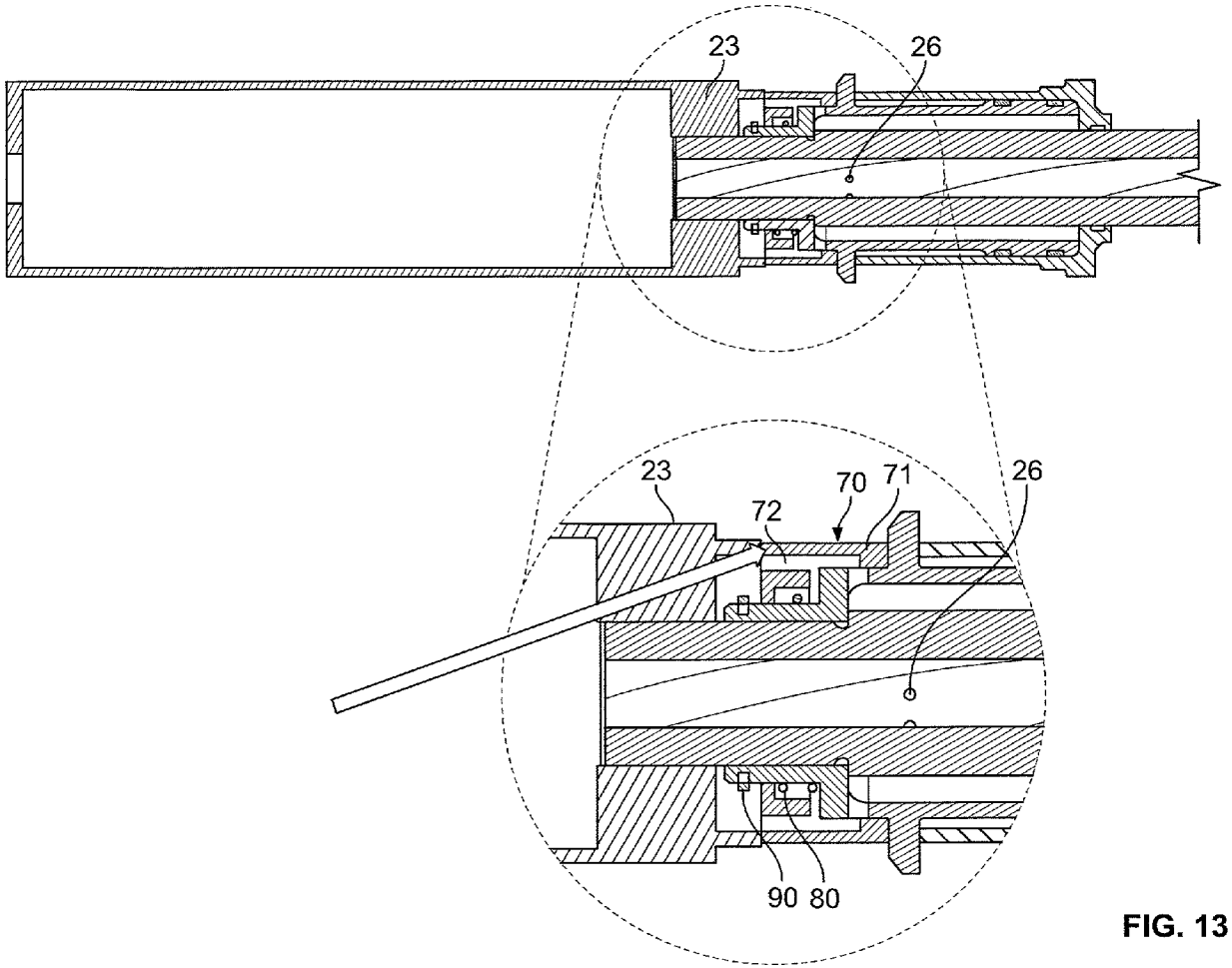
FIG. 13 shows the barrel with the suppressor installed and the valve pushed back by the suppressor.

In accordance with this specific aspect of the invention, a suppressor 23, such as the suppressor shown in FIG. 1, is threaded on to the barrel 11 to engage the valve 70 to displace it rearwardly into the "open" position shown in FIG. 12, thereby unblocking the ports 60 from the collar 71 and permitting communication to the atmosphere from the interior of the barrel 11 through the radial ports 26 in the barrel and through the radial ports 60 in the piston and through the venting channels 72. As shown in FIGS. 12A and 12B, with the suppressor 23 on, the valve 70 will be pushed back by the suppressor 23 (see the arrow in FIG. 12A) to the "OPEN" position, and part of the gas will go out from the valve 70 through the gas vent channels 72. FIG. 13 is a view similar to FIG. 12B only it shows the barrel 11 with the suppressor 23 installed; as can be seen by the arrow in the figure the valve 70 is pushed back by the suppressor 23. In this alternative arrangement, no manual adjustment of the valve 70 by rotation or otherwise is required. It is normally closed when on the barrel 11 with the assembled biasing spring 80 and snap ring 90. When the suppressor 23, functioning as a simple locking nut, is threaded on to the barrel, it automatically overcomes the spring bias and opens valve 70 while completing the assembly of the gas operating system itself.

Figure 14A:
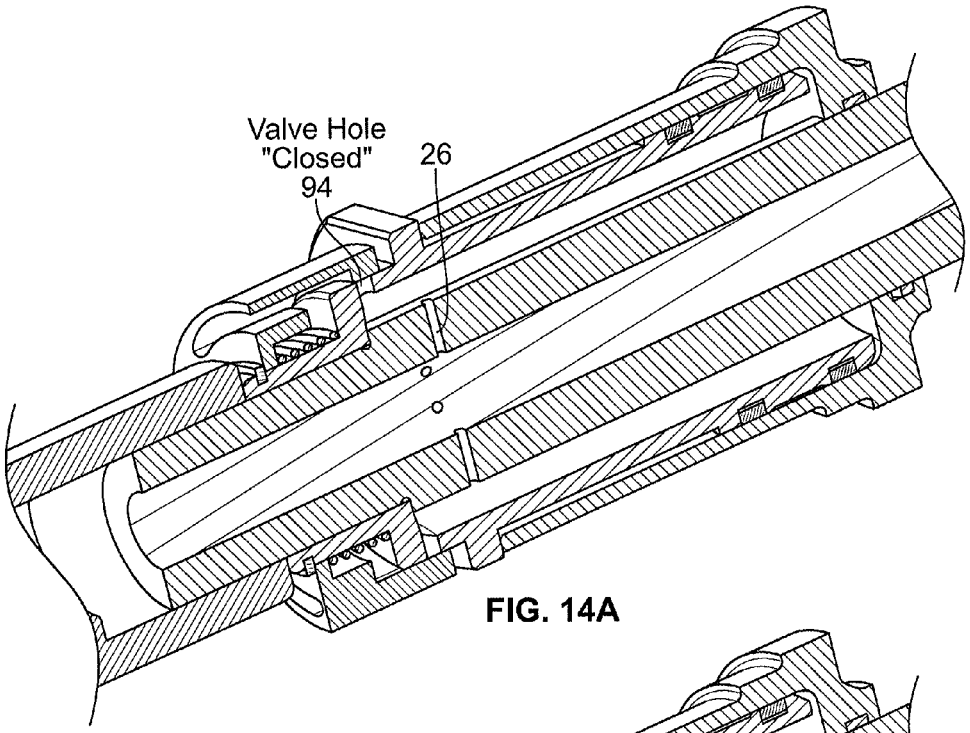
FIGS. 14A and 14B show the present invention without and with a suppressor, respectively.
Figure 14B:
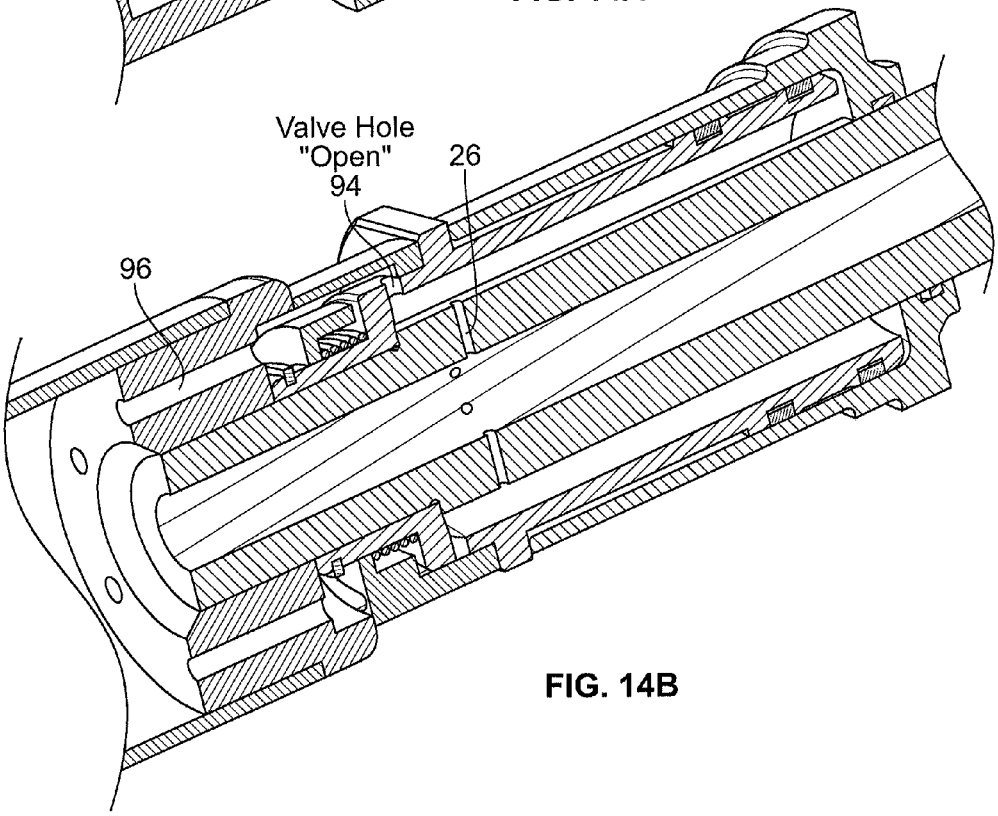

FIGS. 14A and 14B show the present invention of this embodiment without a suppressor (FIG. 14A) and with a suppressor (FIG. 14B). In this embodiment the gas will enter the system through the holes 26 on the barrel 11. At this point without a suppressor (FIG. 14A), the gas will be entirely used to cycle the gun, since the valve holes 94 will be closed. With the suppressor 23 (FIG. 14B), the valve will be pushed back and then the valve holes 94 will be open. In such condition, part of the gas will be used to cycle the gun, another part will leave the gas system and will enter the suppressor 23 through the suppressor holes 96, improving the performance of the suppressor 23 itself. In this way, the pressure inside the system will be reduced and the gun will cycle at a slower rate. It should be noted that the gas flow entering the system (the piston 10) is always the same. Thus, with the suppressor 23 the gas enters the suppressor 23 through the holes 94 on the valve, and it should be noted that the valve holes 94 do not reduce the gas flow; they simply allow part of the gas to exit the system. Thus, main components of this embodiment are the valve 70, the spring 80, and the snap ring 90. The suppressor 23, when installed, will directly push the valve 70, which is responsible for the "opening" or for the "closing" of the holes.

Accordingly, with respect to the present invention according to this embodiment, the valve is annular to the barrel. Gas is moved out of the system. Gas is moved from the gas block into the suppressor, to reduce the pressure inside the system and increase the performance of the suppressor. To the contrary, in some prior art systems, the intent is to reduce the flux of the gas that is going into the gas system. However, this could be problematic because it could cause the closing of the small hole of the mechanism due to the unburnt powder and, further, such a system may be highly complicated and difficult to machine.

It will be appreciated that the operating system of the present invention provides many advantages and improvements over known gas piston operating systems. The new design is greatly simplified and especially streamlined, permitting ease of manufacture, cleaning, assembly and disassembly of the components of the system. One unthreading operation of the locking nut/suppressor permits disassembly. Only three parts need to be cleaned. The new design is easy to machine due to only turning operations and one machining operation on the three parts. The use of separate gas sealing rings on the piston and cylinder establishes a gas tight chamber for combustion gases to displace the cylinder while simplifying fabrication. Mounting the piston concentrically on the barrel effectively safely spaces the sliding cylinder from the barrel and eliminates detrimental effects of thermal expansion of the barrel.

The overall design of the new operating system enables an effective mechanism having a short stroke to be reliably incorporated into a small envelope of a small arms barrel. This permits construction of compact and concealable weapons with powerful small caliber. The new design accommodates the inclusion of sufficient gas ports to fire extremely low pressure ammunition. Moreover, by increasing the diameter and number of barrel gas ports, contamination of the weapon is significantly reduced.

The new system can be employed with weapons of widely disparate calibers. The length of the stroke may be adjusted along with sizing the ports and/or varying the number of ports to "fine tune" the operating system to the ammunition being fired in terms of bullet weights and generated gas pressures. The spring-biased valving provided in conjunction with the system is simple and efficient and permits further "fine tuning" of the gas operating system to particular caliber ammunition while having the ability to avoid manual adjustments. By virtue of the features of the present invention it is possible to avoid the manual adjustments of users that are often critical under a stressful operation in the field. The automatic biased valving may be employed in conventional gas operating systems as well as the new and improved annular system disclosed herein.

It should be understood, of course, that the specific form of the invention herein illustrated and described is intended to be representative only, as certain changes may be made therein without departing from the clear teachings of the disclosure. Thus, it should be understood that the embodiments herein have been presented by way of example, and not limitation. It will be apparent to persons skilled in the relevant art(s) that various changes in form and detail can be made therein without departing from the spirit and scope of the present invention. Thus, the present invention should not be limited by any above-described exemplary embodiment.

In addition, it should be understood that the figures illustrated in the attachments, which highlight the functionality and advantages of the present invention, are presented for example purposes only. The architecture of the present invention is sufficiently flexible and configurable, such that it may be utilized (and navigated) in ways other than that shown in the accompanying figures.

The invention claimed is:

1. A gas operating system for engaging the automatic or semi-automatic action of a small arms weapon, comprising:

a gun barrel having a plurality of radial ports and having radial forward and rear stops fixed thereon;

a displaceable cylinder with a gas sealing ring secured thereto, the cylinder having a short stroke between the radial forward and rear stops fixed on the gun barrel;

a fixed piston attached coaxial to the gun barrel and having gas blocking sealing rings at rearward exterior surfaces of the piston;

a gas chamber, formed by interior walls of the cylinder and piston and by outer surfaces of the gun barrel, wherein gas tightness of the gas chamber is established by the gas sealing ring of the cylinder and by the gas blocking sealing rings of the piston, and wherein the gas chamber receives in operation pressurized combustion gas from fired ammunition, the gas entering through the radial ports of the gun barrel; and a single locking nut comprising a threaded flash suppressor, configured to lock the piston over the gun barrel, wherein the rear stop is cylindrical and is threaded axially to the gun barrel so that the rear stop is rotatable to finely adjust the short stroke of the cylinder.

2. The gas operating system of claim 1, wherein the piston further comprises a forwardly projecting collar with an annular stop disc at an outer forward end of the forwardly projecting collar to limit forward travel of the cylinder.

3. The gas operating system of claim 2, further comprising a manual valving system for the piston, to reduce pressure in the gas chamber, the manual valving system comprising:

an adjustable rotatable collar supported in slots formed in the annular stop disc, the adjustable rotatable collar having arms with stopper surfaces thereon; and a plurality of ventilation ports formed in a forward wall of the piston, the ventilation ports configured to be selectively openable and closeable by manually rotating the adjustable rotatable collar which moves the arm and thereby the stopper surfaces to open and close the ventilation ports to control the pressure in the gas chamber, wherein the single locking nut is configured to fix the piston to a forward end of the gun barrel, and wherein when the ventilation ports are open at least part of the gas exits the piston reducing the pressure in the gas chamber, and when the ventilation ports are closed no gas exits from the piston during firing.

4. The gas operating system of claim 1, further comprising an automatic spring-loaded valving system for the piston, to reduce pressure in the gas chamber, the automatic spring-loaded valving system comprising:

a plurality of radial piston ports formed in a forwardly extending annular collar of the piston; and a cylindrical valve secured to the gun barrel by a snap ring and mounted for limited axial movement on the gun barrel with respect to the radial piston ports, the cylindrical valve having a rear cylindrical collar and venting channels formed forwardly of the rear cylindrical collar, the rear cylindrical collar being normally biased forwardly by a biasing spring into a valve closed position, and in the valve closed position a sealing surface of the rear cylindrical collar blocks the radial piston ports such that no gas exits the piston during firing, wherein the single locking nut threaded onto the gun barrel is configured to engage the cylindrical valve to displace the cylindrical valve rearwardly into a valve open position, thereby unblocking the radial piston ports from the sealing surface of the rear cylindrical collar and permitting gas to exit from the radial piston ports through the venting channels of the cylindrical valve through the radial ports of the gun barrel and into the atmosphere.

5. The gas operating system of claim 1, wherein in operation the pressurized combustion gas received in the gas chamber acts against the cylinder to effect rearward movement of the cylinder with respect to the piston, the gas operating system further comprising a bolt carrier freely engaging a rear wall of the cylinder and configured to be engaged by the rearward movement of the cylinder to start the action of the weapon, the bolt carrier being forward biased and in operation urging the cylinder back to a forwardmost position, thereby expelling gas from the gas chamber back through the radial ports and out the gun barrel.

6. A gas operating system for engaging the automatic or semi-automatic action of a small arms weapon, comprising:

a gun barrel having a plurality of radial ports;

a fixed piston mounted coaxial with and secured to the gun barrel, the piston having annular grooves formed on rearward outer walls of the piston and gas blocking sealing rings disposed in the annular grooves;

a sliding cylinder mounted telescopically on the piston, the cylinder having inner surfaces and an interior wall and being open at a forward end and closed by a rear wall;

a gas chamber formed in part by the interior wall of the cylinder and outer surfaces of the gun barrel and further by the inner surfaces and the rear wall of the cylinder, wherein the rear wall of the cylinder has a circular opening supporting a gas sealing ring of the cylinder which slidingly and sealingly engages the outer surfaces of the gun barrel, wherein gas tightness of the gas chamber is established by the gas sealing ring of the cylinder and by the gas blocking sealing rings of the piston, the gas chamber being configured to, in operation, receive from the gun barrel pressurized combustion gas from fired ammunition, the gas entering through the radial ports of the gun barrel, the gas acting against the cylinder to effect rearward movement of the cylinder with respect to the piston; and a bolt carrier freely engaging the rear wall of the cylinder and configured to be engaged by the rearward movement of the cylinder to start the action of the weapon, the bolt carrier being forward biased and in operation urging the cylinder back to a forwardmost position, thereby expelling gas from the gas chamber back through the radial ports and out the gun barrel, wherein the gun barrel further comprises:

a stop disc to limit forward travel of the cylinder; and a cylindrical rear stop secured by interior threads to mating threads on the gun barrel to limit rearward travel of the cylinder, wherein the cylindrical rear stop is rotatable to adjust the stroke of the cylinder, the cylinder having a short stroke between the stop disc and the cylindrical rear stop.

7. The gas operating system of claim 6, wherein the piston further comprises:

a forwardly projecting collar with an annular stop disc at an outer forward end of the forwardly projecting collar to limit forward travel of the cylinder.

8. The gas operating system of claim 7, further comprising a manual valving system for the piston, to reduce pressure in the gas chamber, the manual valving system comprising:

an adjustable rotatable collar supported in slots formed in the annular stop disc, the adjustable rotatable collar having arms with stopper surfaces thereon;

a plurality of ventilation ports formed in a forward wall of the piston, the ventilation ports configured to be selectively openable and closeable by manually rotating the adjustable rotatable collar which moves the arm and thereby the stopper surfaces to open and close the ventilation ports to control the pressure in the gas chamber; and a threaded locking nut member configured to fix the piston to a forward end of the gun barrel, wherein when the ventilation ports are open at least part of the gas exits the piston reducing the pressure in the gas chamber, and when the ventilation ports are closed no gas exits from the piston during firing.

9. The gas operating system of claim 6, further comprising a single locking nut, configured to lock the piston over the gun barrel, wherein the single locking nut is a threaded flash suppressor.

10. The gas operating system of claim 9, wherein the piston has a shoulder which engages another shoulder formed on an outer surface of the gun barrel before the piston is locked over the gun barrel by the single locking nut.

11. The gas operating system of claim 6, wherein the piston is directly threadedly fastened to the gun barrel.

12. The gas operating system of claim 6, further comprising an automatic spring-loaded valving system for the piston, to reduce pressure in the gas chamber, the automatic spring-loaded valving system comprising:

a plurality of radial piston ports formed in a forwardly extending annular collar of the piston;

a cylindrical valve secured to the gun barrel by a snap ring and mounted for limited axial movement on the gun barrel with respect to the radial piston ports, the cylindrical valve having a rear cylindrical collar and venting channels formed forwardly of the rear cylindrical collar, the rear cylindrical collar being normally biased forwardly by a biasing spring into a valve closed position, and in the valve closed position a sealing surface of the rear cylindrical collar blocks the radial piston ports such that no gas exits the piston during firing; and a suppressor threaded onto the gun barrel and configured to engage the cylindrical valve to displace the cylindrical valve rearwardly into a valve open position, thereby unblocking the radial piston ports from the sealing surface of the rear cylindrical collar and permitting gas to exit from the radial piston ports through the venting channels of the cylindrical valve through the radial ports of the gun barrel and into the atmosphere.

13. A gas operating system for engaging the automatic or semi-automatic action of a small arms weapon, comprising:

a gun barrel having a plurality of radial ports and having radial forward and rear stops fixed thereon;

a displaceable cylinder with a gas sealing ring secured thereto, the cylinder having a short stroke between the radial forward and rear stops fixed on the gun barrel;

a fixed piston attached coaxial to the gun barrel and having gas blocking sealing rings at rearward exterior surfaces of the piston; and a gas chamber, formed by interior walls of the cylinder and piston and by outer surfaces of the gun barrel, wherein gas tightness of the gas chamber is established by the gas sealing ring of the cylinder and by the gas blocking sealing rings of the piston, and wherein the gas chamber receives in operation pressurized combustion gas from fired ammunition, the gas entering through the radial ports of the gun barrel, wherein the rear stop is cylindrical and is threaded axially to the gun barrel so that the rear stop is rotatable to finely adjust the short stroke of the displaceable cylinder, wherein the piston further comprises a forwardly projecting collar with an annular stop disc at an outer forward end of the forwardly projecting collar to limit forward travel of the cylinder, the gas operating system further comprising a manual valving system for the piston, to reduce pressure in the gas chamber, the manual valving system comprising:

an adjustable rotatable collar supported in slots formed in the annular stop disc, the adjustable rotatable collar having arms with stopper surfaces thereon;

a plurality of ventilation ports formed in a forward wall of the piston, the ventilation ports configured to be selectively openable and closeable by manually rotating the adjustable rotatable collar which moves the arm and thereby the stopper surfaces to open and close the ventilation ports to control the pressure in the gas chamber; and a threaded locking nut member configured to fix the piston to a forward end of the gun barrel, wherein when the ventilation ports are open at least part of the gas exits the piston reducing the undue pressure in the gas chamber, and when the ventilation ports are closed no gas exits from the piston during firing.

14. The gas operating system of claim 13, wherein in operation the pressurized combustion gas received in the gas chamber acts against the cylinder to effect rearward movement of the cylinder with respect to the piston, the gas operating system further comprising a bolt carrier freely engaging a rear wall of the cylinder and configured to be engaged by the rearward movement of the cylinder to start the action of the weapon, the bolt carrier being forward biased and in operation urging the cylinder back to a forwardmost position, thereby expelling gas from the gas chamber back through the radial ports and out the gun barrel.

15. A gas operating system for engaging the automatic or semi-automatic action of a small arms weapon, comprising:

a gun barrel having a plurality of radial ports and having radial forward and rear stops fixed thereon;

a displaceable cylinder with a gas sealing ring secured thereto, the cylinder having a short stroke between the radial forward and rear stops fixed on the gun barrel;

a fixed piston attached coaxial to the gun barrel and having gas blocking sealing rings at rearward exterior surfaces of the piston; and a gas chamber, formed by interior walls of the cylinder and piston and by outer surfaces of the gun barrel, wherein gas tightness of the gas chamber is established by the gas sealing ring of the cylinder and by the gas blocking sealing rings of the piston, and wherein the gas chamber receives in operation pressurized combustion gas from fired ammunition, the gas entering through the radial ports of the gun barrel, wherein the rear stop is cylindrical and is threaded axially to the gun barrel so that the rear stop is rotatable to finely adjust the short stroke of the displaceable cylinder, the gas operating system further comprising an automatic spring-loaded valving system for the piston, to reduce undue pressure in the gas chamber, the automatic spring-loaded valving system comprising:

a plurality of radial piston ports formed in a forwardly extending annular collar of the piston;

a cylindrical valve secured to the gun barrel by a snap ring and mounted for limited axial movement on the gun barrel with respect to the radial piston ports;

the cylindrical valve having a rear cylindrical collar and venting channels formed forwardly of the rear cylindrical collar, the rear cylindrical collar being normally biased forwardly by a biasing spring into a valve closed position, and in the valve closed position a sealing surface of the rear cylindrical collar blocks the radial piston ports such that no gas exits the piston during firing; and a suppressor threaded onto the gun barrel and configured to engage the cylindrical valve to displace the cylindrical valve rearwardly into a valve open position, thereby unblocking the radial piston ports from the sealing surface of the rear cylindrical collar and permitting gas to exit from the radial piston ports through the venting channels of the cylindrical valve through the radial ports of the gun barrel and into the atmosphere.

* * * * *